United States Patent [19]

Stelter et al.

[11] 4,208,976

[45] Jun. 24, 1980

[54] TAB APPLICATOR AND BONDING APPARATUS AND METHOD OF UTILIZING THE SAME

[75] Inventors: Ronald B. Stelter, Country Club Hills; Raymond P. Kulka, Chicago; John Florczak, Westchester; Peter A. Simonelis, Chicago; Edward J. Fiala, Oak Lawn, all of Ill.

[73] Assignee: The Continental Group, Inc., New York, N.Y.

[21] Appl. No.: 962,412

[22] Filed: Nov. 20, 1978

[51] Int. Cl.[2] ..... B21D 51/44

[52] U.S. Cl. ..... 113/121 A; 29/773; 29/795; 113/1 F; 113/113 D; 113/114 BF; 113/120 Q; 113/121 C

[58] Field of Search ..... 113/1 R, 1 F, 15 R, 113/15 A, 113 R, 113 D, 114 BA, 114 BE, 114 BF, 114 BG, 120 Q, 121 R, 121 C; 156/69, 196, 212, 228, 362, 567, 572; 29/771, 773, 774, 775, 785, 789, 792, 795, 809, 810, 818

[56] References Cited

U.S. PATENT DOCUMENTS

| | | | |
|---|---|---|---|
| 1,975,979 | 10/1934 | Sebell | 113/15 A |
| 3,249,483 | 5/1966 | Kauffman et al. | 156/567 |
| 3,422,597 | 1/1969 | Beer | 29/773 |
| 3,791,894 | 2/1974 | Mistarz | 156/362 |
| 3,905,859 | 9/1975 | Patterson | 156/458 |
| 4,026,226 | 5/1977 | Hahn | 113/113 R |
| 4,122,790 | 10/1978 | Rowe et al. | 113/121 R |

*Primary Examiner*—Leon Gilden
*Attorney, Agent, or Firm*—Charles E. Brown

[57] ABSTRACT

Apparatus for applying pull tabs to container panels wherein tabs are singly fed from a stack onto a heated first anvil, each tab is then clamped to its respective anvil and an end portion thereof bent at right angles to the remainder of the tab. The bent tab is then transferred by way of the anvil into opposed relation to a bonding anvil which lifts a pre-heated end unit into contact with a pre-heated tab and applied pressure effects bonding of the tab to the end unit.

9 Claims, 1 Drawing Figure

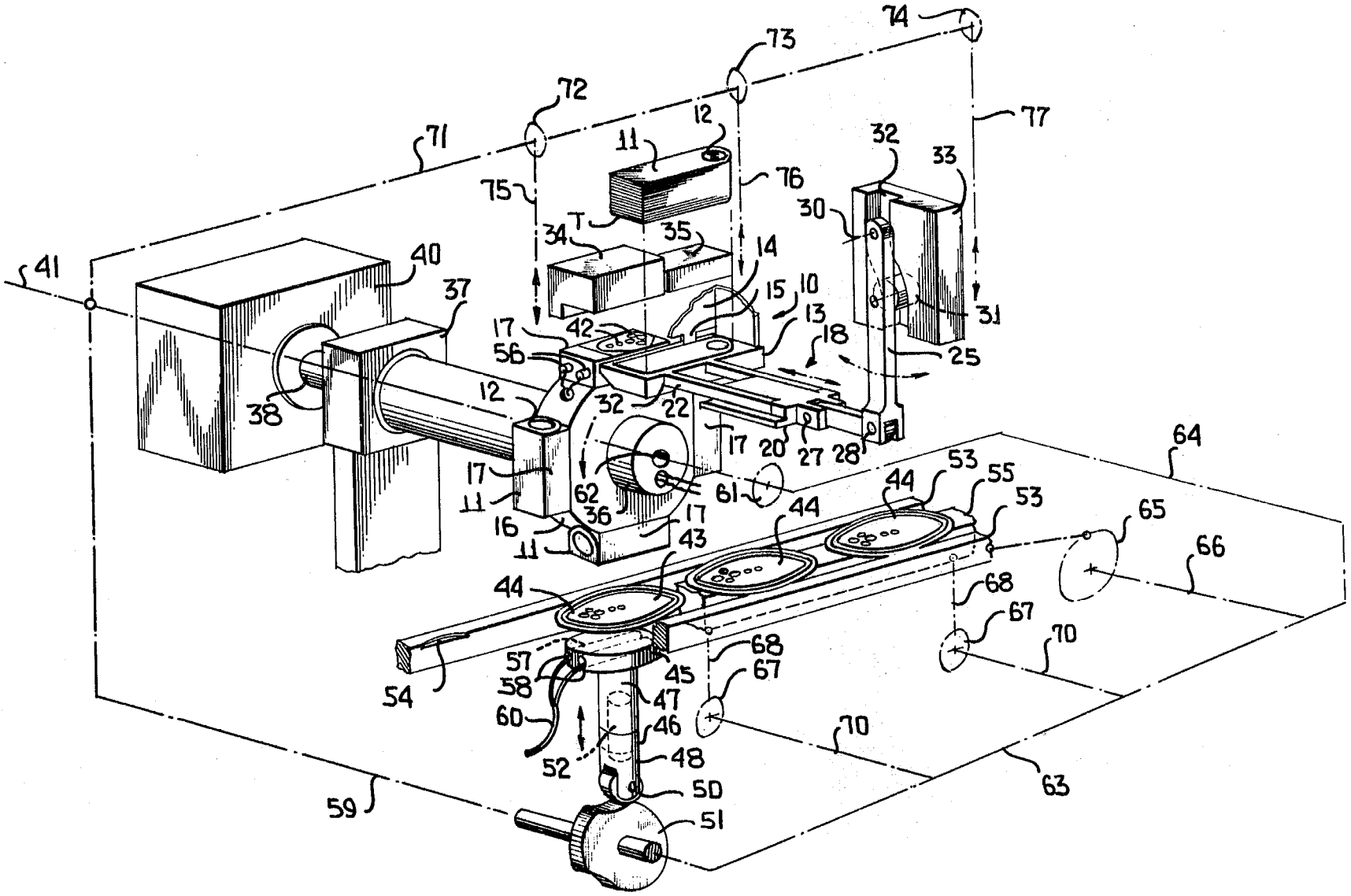

TAB APPLICATOR AND BONDING APPARATUS AND METHOD OF UTILIZING THE SAME

This invention relates in general to new and useful improvements in easy opening containers, and more particularly to easy opening containers having a pull tab bonded thereto.

This invention relates to an apparatus for automatically applying a pull tab to an end panel of an end unit for a can of the beer and beverage type.

In accordance with this invention the tabs are arranged in a stack within a magazine or hopper which is located adjacent a transfer wheel having a plurality of circumferentially spaced anvils. A suitable feed mechanism is provided for transferring a single tab in sequence to each anvil, after which the tab is first clamped to the anvil and then an end portion of the tab projecting beyond the anvil is bent as is desired to provide an offset grip portion.

The transfer wheel is rotated with the tab being held on its respective anvil by vacuum until the anvil is in alignment with an end unit carried by a feed slide. A bonding anvil, located beneath the end unit, is then raised to lift the pre-heated end unit into contact with the tab and results in the holding of the end unit against the tab for a sufficient time to permit bonding of the heated tab to the end panel thereof.

With the above and other objects in view that will hereinafter appear, the nature of the invention will be more clearly understood by reference to the following detailed description, the appended claims, and the accompanying drawing.

IN THE DRAWING

The drawing is an exploded schematic perspective view of the apparatus with the various drive components being diagrammatically shown.

Referring now to the drawing, it is to be seen first of all that there is illustrated a magazine or hopper 10 for the reception of a stack of tabs T. It is to be understood that the tabs T are preferably formed of a metal foil-plastic film laminate with the plastic film being directly bondable to a coated container panel. Each tab T has an end portion 11 with an opening 12 therein forming a finger gripping opening.

The feed magazine or hopper 10 includes a base 13 and suitable upstanding walls including a back wall 14 which has a controlled gap 15 between the underside thereof and the base 13 which permits the removal of a single tab T at a time.

A transfer wheel 16 having a plurality of anvils 17 mounted thereon in circumferentially spaced relation is positioned with respect to the feed magazine or hopper 10 so that an upper surface of the uppermost one of the anvils 17 is coplanar with the upper surface of the base 13 and is positioned immediately adjacent the base 13 for receiving a tab from the feed magazine or hopper 10. A feed mechanism, generally identified by the numeral 18, is provided for feeding the lowermost tab T through the gap 15 onto the uppermost anvil 17.

The feed mechanism 18 includes a suitable slide 20 having arms 22 extending through notches 23 formed in the base. The arms 22 extend generally toward the uppermost anvil 17 and define shoulders 24 which engage each edge of a lowermost tab T to effect shifting thereof onto the uppermost anvil 17.

The slide 20 may be mounted for reciprocating sliding movement by means of any conventional type of support. The slide 20 is reciprocated by means of a lever 25 which is connected to the slide through a link 26 which is pivotally connected to the slide 20 by a pin 27 and to the lever 25 by a pin 28.

The upper end of the lever 25 is suitably mounted for pivoting about an axis 30. The lever 25 carries a cam follower 31 which is seated on a cam track 32 of a slide drive cam 33. The slide drive cam 33 is reciprocated in timed relation to the movement of the transfer wheel 16 in a manner to be described in more detail hereinafter.

After the tab T has been fed onto the anvil 17, a clamping pad 34 moves down and clamps the tab against the upper surface of the anvil 17. At the same time, a tab bending finger 35 moves down, and as the tab is clamped against the anvil 17 by the clamping pad 34, the tab bending finger 35 moves down past the anvil 17 to bend the projecting end portion 11 of the tab down alongside the anvil at generally right angles to the remainder of the tab.

The transfer wheel 16 is carried by a suitable shaft 36 which is mounted for rotation in acceptable supports including the illustrated support 37. The shaft 36 is driven by a shaft 38 of an indexing drive unit 40 which has a primary drive shaft 41 coupled thereto. After the tab has been clamped against the anvil 17, the tab is held in place on the anvil by drawing a vacuum through a plurality of openings 42 formed in the anvil. Thus, when the anvil is rotated from an upwardly facing position first to a horizontally facing position and then to a downwardly facing position, the tab will remain in position on the anvil 17.

The tab is applied to an end panel 43 of an end unit 44 when the tab is in the lowermost anvil position. At this time, an end unit 44 has been positioned in alignment with the lowermost anvil 17 and between that anvil and a bonding anvil 45. The bonding anvil 45 is carried by a two-piece telescoping rod 46 which includes an upper rod portion 47 carrying the anvil 45 and a lower rod portion 48 carrying a cam follower 50 which engages a cam 51. Normally the rod portions 47, 48 are urged apart by an internal compression spring 52 which allows telescoping of the rod portions under pressure. It is to be understood that the bonding anvil 45 is elevated to lift an end unit 44 into contact with the tab carried by the lowermost anvil 17 and that the spring 52 permits a telescoping of the rod portions, thereby to control the pressure at which the end unit is applied to the tab.

The end unit 44, together with like end units which have been previously oriented, is fed in a step-by-step motion by a pair of feed slides 53 which are interconnected. The feed slides 53 have formed in the upper surfaces thereof notches 54 forming seats for diametrically opposite portions of the end units 44.

In order that the feed slides 53 may sequentially advance the end units 44, a suitable intermediate support 55 is also moved upwardly so that all of the end units 44 following the end unit to which the tab is to be applied are elevated above the feed slides 53 so that the feed slides 53 may retract for receiving a next end unit and be positioned for advancing the whole line of end units one step.

At this time it is pointed out that the anvils 17 are heated by means of an electrical heater of which contacts 56 have been illustrated. Suitable wiring for the electrical heaters 56 is provided, with this wiring being carried by the shaft 36 in any desired manner for coupling to a source of electrical energy.

The bonding anvil 45 is also provided with an electrical heater 57 having electrical contacts 58 to which suitable wiring 60 is connected to maintain the end at a predetermined temperature.

It is to be understood that suitable manifolding may be provided within the transfer wheel 16 so that vacuum is supplied to the openings 42 in the anvils 17 only while the anvils are at or between the upper position and the bottom position in the direction of rotation of the transfer wheel which is illustrated as being counterclockwise. Further, a suitable control valve 61 may be provided for controlling the application of vacuum to a vacuum passage 62 in the shaft 36 so that immediately after the tab is bonded to the end unit, the vacuum is released so that when the end unit is lowered by the bonding anvil 45, the tab is free to move downwardly therewith.

It is to be understood that all of the mechanisms are to be actuated in unison. Accordingly, there is illustrated a schematic drive for the various components. As stated above, the rod 46 is reciprocated by means of a cam 51. The cam 51 has a drive shaft 59 which is suitably coupled to the main drive shaft 41 in any conventional manner. A further drive shaft 63 is schematically illustrated as extending from the shaft 59 and further having extending therefrom a shaft 64 connected to the rotary valve 61.

A cam or eccentric wheel 65 is illustrated for reciprocating the feed slides 53, and this cam is driven by a shaft 66 suitably coupled, for example, to the shaft 63.

The support 55 is elevated in timed relation to the actuation of the feed slides 53 by a pair of cams 67 and suitable support rods 68 with the cams 67 being illustrated as driven by shafts 70 suitably coupled indirectly to the main drive shaft 41.

A further drive shaft 71 is suitably coupled to the main drive shaft 41 and drives cams 72, 73 and 74. The cam 72 is coupled by a suitable rod-like coupling 75 to the clamping pad 34 for raising and lowering the same in timed relation to the rotation of the transfer wheel 16. In a like manner the tab bending finger 35 is raised and lowered by means of the cam 73 through a suitable coupling rod 76. Finally, the cam 74 is utilized to raise and lower the slide drive cam 33 by means of a suitable coupling rod 77.

OPERATION

With the transfer wheel 16 in the illustrated position, the feed mechanism 18 is actuated to slide the lowermost tab from the feed magazine 10 onto the surface of the uppermost anvil 17. The tab is held in position by the application of a vacuum through the openings 42.

Immediately after the tab is positioned on the anvil, it is clamped in place by the clamping pad 34, followed by the bending of the end portion 11 due to the descent of the tab bending finger 35.

When the feed mechanism 18 is retracted and the clamping pad 34 and the tab bending finger 35 are elevated, the transfer wheel 16 is rotated 90° in a counterclockwise direction. Thus the tabs, with the end portions 11, are advanced toward the application position.

It is to be understood that while the transfer wheel 16 is being indexed, the feed slides 53 are advancing an end unit into position to receive a tab. At the same time as a new tab is being applied to the uppermost anvil, the bonding anvil is elevating an end unit into engagement with the tab carried by the lowermost anvil 17 to transfer and to bond that tab to the end unit. It is to be understood that the tab is pre-heated by means of the anvil carrying the same and that the end unit, which has been preheated in a previous station is maintained at a desired temperature on anvil 45 so that the plastics material film of the tab will be sufficiently melted to effect bonding thereof to the coated surface of the end unit.

After the tab has been applied to an end unit, the end unit is transferred by the feed slides out of the apparatus.

Although only a preferred embodiment of the apparatus has been specifically illustrated and described herein, it is to be understood that minor variations may be made in the apparatus without departing from the spirit and scope of the invention as defined by the appended claims.

We claim:

1. Apparatus for applying pull tabs to container panels, said apparatus comprising hopper means for supporting a stack of tabs, support means for positioning a container panel for receiving a tab, and transfer means positioned adjacent said hopper means and said support means for receiving a tab from said hopper means and transferring the same to a container panel, said transfer means being in the form of a transfer wheel mounted for rotation about an axis, said transfer wheel having at least one anvil for receiving a tab from said hopper means, said anvil corresponding in outline to an intended bond between one of said tabs and a container panel.

2. The apparatus of claim 1 wherein said anvil has vacuum retaining means for holding a tab thereof during the transfer of said tab.

3. The apparatus of claim 1 wherein said anvil has means for heating the same to effect heating of a tab for application to a container panel.

4. The apparatus of claim 3 together with tab bending means moveable alongside said anvil when said clamp means is clamping a tab against said anvil to bend an end portion of the tab out of the general plane of the tab.

5. Apparatus for applying pull tabs to container panels, said apparatus comprising hopper means for supporting a stack of tabs, support means for positioning a container panel for receiving a tab, and transfer means positioned adjacent said hopper means and said support means for receiving a tab from said hopper means and transferring the same to a container panel, said transfer means being in the form of a transfer wheel mounted for rotation about an axis, said transfer wheel having at least one anvil for receiving a tab from said hopper means, and clamp means for momentarily clamping a tab against said anvil.

6. The apparatus of claim 1 together with feed means for sequentially feeding a single tab laterally from the bottom of said stack of tabs in said hopper means to said transfer means.

7. The apparatus of claim 6 wherein said feed means includes a cam actuated lever, and a slide drive cam coupled to said lever.

8. Apparatus for applying pull tabs to container panels, said apparatus comprising hopper means for supporting a stack of tabs, support means for positioning a container panel for receiving a tab, and transfer means positioned adjacent said hopper means and said support means for receiving a tab from said hopper means and transferring the same to a container panel, and a bonding anvil for temporarily removing a container panel from said support means and presenting said container panel to said transfer means for receiving the tab therefrom.

9. A method of applying a pull tab to a container panel, said method comprising the steps of assembling tabs in a stack, transferring a tab from the stack to a first anvil, clamping the tab against the first anvil and while so holding the tab bending an end portion of the tab at an angle to the remainder of the tab, moving the first anvil into opposing relation to a second anvil, positioning a pre-heated container panel between and in alignment with the anvils, and then clamping the container panel between the anvils while maintaining heat to bond the tab to the container panel.

* * * * *